United States Patent [19]

Hawthorne et al.

[11] 4,244,298

[45] Jan. 13, 1981

[54] FREIGHT CAR TRUCK ASSEMBLY

[75] Inventors: V. Terrey Hawthorne, Radnor; Stuart A. Schwam, Narberth, both of Pa.

[73] Assignee: Railroad Dynamics, Inc., Ardmore, Pa.

[21] Appl. No.: 29,260

[22] Filed: Apr. 11, 1979

[51] Int. Cl.[3] ..... B61F 5/12; B61F 5/50

[52] U.S. Cl. ..... 105/197 D; 267/9 A

[58] Field of Search ..... 105/197 DB, 197 D; 267/3, 4, 9 A, 9 C

[56] References Cited

U.S. PATENT DOCUMENTS

| | | | |
|---|---|---|---|
| 2,375,206 | 5/1945 | Baselt et al. | 105/197 D |
| 2,375,207 | 5/1945 | Cottrell | 105/197 D |
| 3,024,743 | 3/1962 | Williams et al. | 105/197 D |
| 3,127,850 | 4/1964 | Clasen | 105/197 D |
| 3,408,955 | 11/1968 | Barber | 105/197 D |
| 3,559,589 | 2/1971 | Williams | 105/197 D |
| 3,687,086 | 8/1972 | Barber | 105/197 DB |
| 3,714,905 | 2/1973 | Barber | 105/197 DB |
| 3,851,595 | 12/1974 | Clasen | 105/197 DB |
| 4,084,514 | 4/1978 | Bullock | 105/197 DB |
| 4,103,623 | 8/1978 | Radwill | 105/197 DB |
| 4,109,585 | 8/1978 | Brose | 105/197 DB |

*Primary Examiner*—Richard A. Bertsch
*Attorney, Agent, or Firm*—Louis V. Schiavo

[57] ABSTRACT

Wedges of novel design are interposed between the side frames and bolster of a three-piece freight car truck assembly in an effort to provide an assembly having greater high speed stability.

21 Claims, 26 Drawing Figures

WITH VERTICAL MOTION

VARY COEFFICIENT OF FRICTION, μ

FREIGHT CAR TRUCK ASSEMBLY

BACKGROUND OF THE INVENTION

1. Field of the Invention

The present invention relates to improvements in three-piece freight car truck assemblies.

2. Description of the Prior Art

In a three-piece truck assembly, the side frames and bolster normally are square, i.e., the wheelsets and bolster (parallel to one another) are disposed normal to the side frames. Occasionally, however, at certain car speeds, the truck may become dynamically unstable, a phenomenon known as truck hunting, manifested by the truck going out of square or warping. The prior art teaches several ways of preventing truck hunting, e.g., the use of resilient side bearings, increasing warp stiffness, steering the wheelsets, the use of conconical wheel profiles, reducing lateral resistance, etc., and the literature has reported certain levels of warp stiffness achieved by three-piece truck assemblies. But numerous tests run to confirm the reported data show that warp stiffness of the levels reported by the literature cannot be achieved with known designs of three-piece freight car truck assemblies, and it appears that the reason for the lack of warp stiffness is instability of the wedges within the pockets.

SUMMARY OF THE INVENTION

The principal object of the present invention is to provide a wedge system which is capable of achieving a warp stiffness high enough to elevate the critical speed of truck hunting (the speed at which hunting will first occur) to a level suitable for freight car operation.

A further object is to provide a wedge system which requires very little change from, and which is competitive with, conventional designs.

Figure 1:
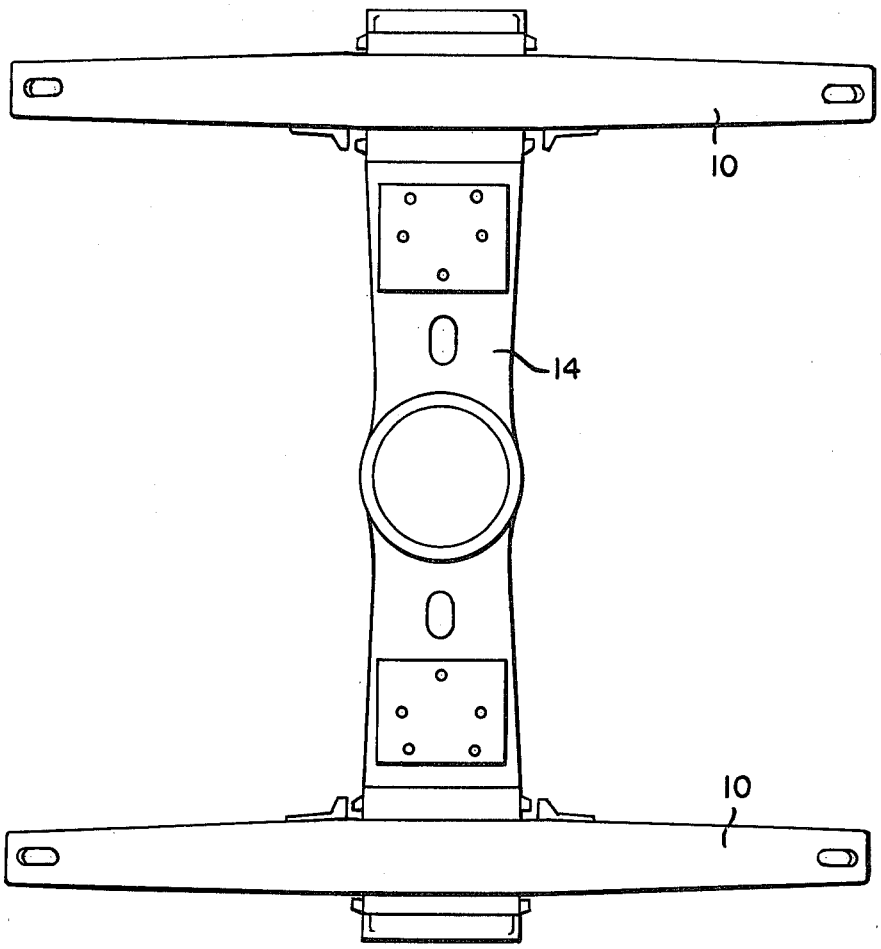
FIG. 1 is a plan view showing the side frames and bolster of a typical three-piece freight car truck assembly.
Figure 2:
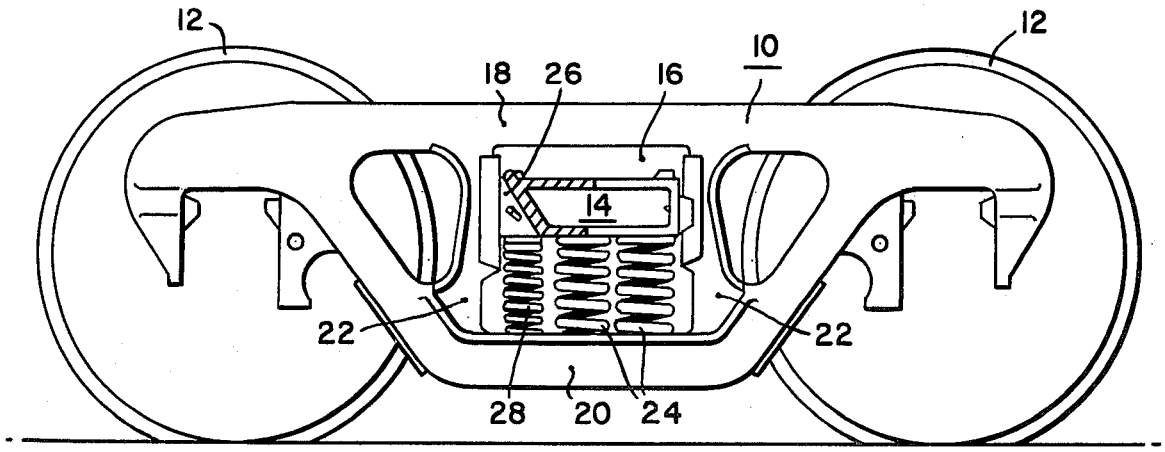
FIG. 2 is an elevation looking at a side frame of the truck assembly, part being broken away to expose others.
Figure 5:
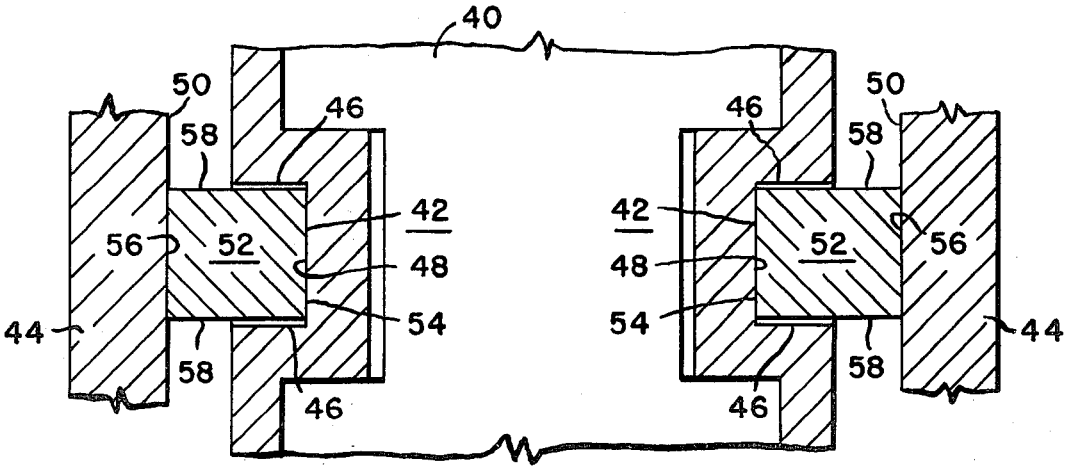
FIG. 5 is a section on lines V—V in FIG. 3.
Figure 6:
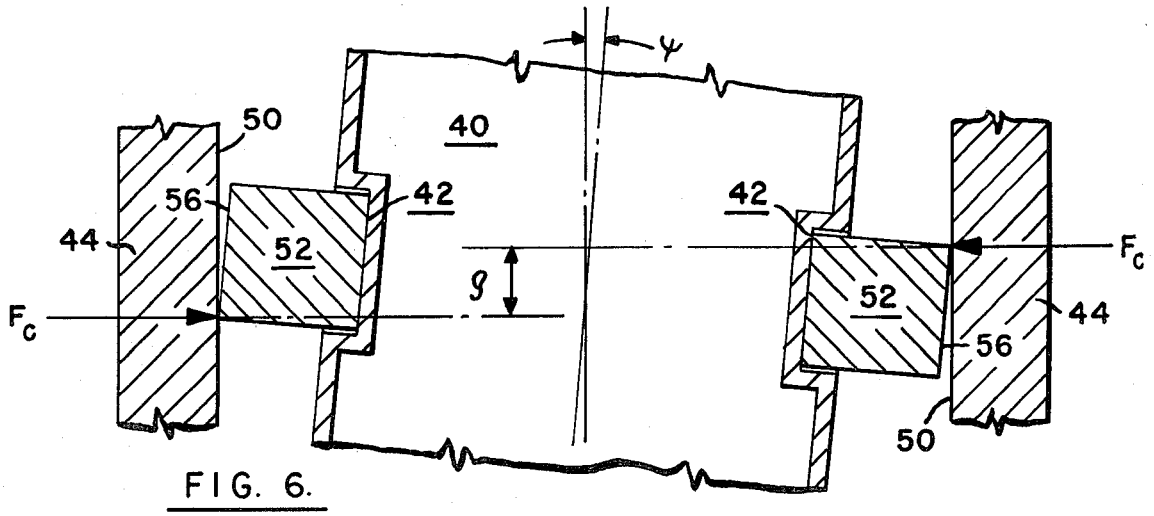
FIG. 6 is similar to FIG. 5, but shows the bolster angled relative to the side frame, as when the assembly is warped.
Figure 7:
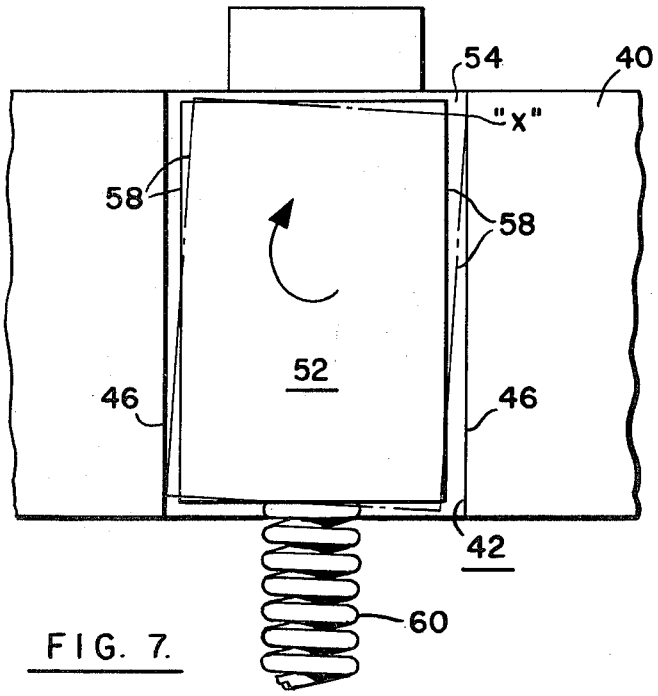
FIG. 7 is a section on lines VII—VII in FIG. 3, diagrammatically illustrating horizontal rotation of the wedge.
Figure 8:
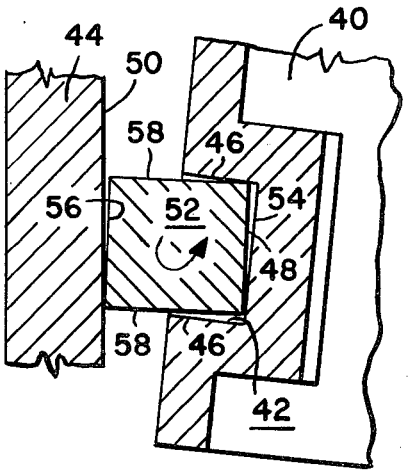
FIG. 8 diagrammatically shows the bolster angled relative to the side frame with the wedge unsecured, and illustrating vertical rotation of the wedge.
Figure 9:
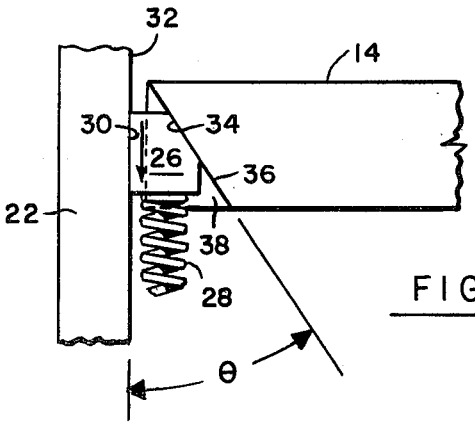
FIG. 9 is a diagrammatic showing of a conventional wedge system.
Figure 16:
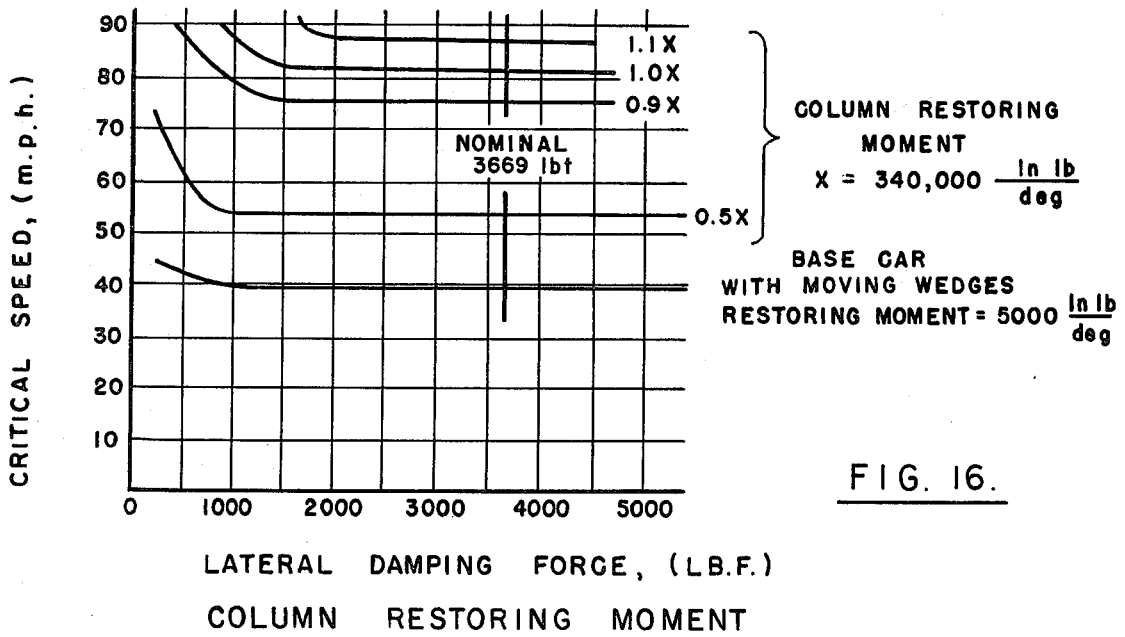
FIG. 16 is a diagram showing critical speed plotted against lateral damping force for varying values of column restoring moment.

DESCRIPTION OF THE PREFERRED EMBODIMENT:

Referring particularly to FIGS. 1 and 2, a typical freight car truck assembly may comprise a pair of laterally spaced side frames 10 carried by a pair of wheelsets 12 and spanned by a bolster 4. Each side frame is provided with an opening 16 defined by a compression member 18, a tension member 20, and a pair of side frame columns 22. The opposite end portions of the bolster 14 extend respectively through the openings 16 and are carried respectively by spring groups 24 acting against side frame spring seats. In the arrangement shown particularly in FIG. 2, a friction wedge, generally designated 26, is carried by a spring 28 acting against the side frame spring seat to urge the wedge upwardly between the bolster and the side frame column. As the bolster moves vertically, the friction wedges slide against the side frame columns to generate damping forces. Since the spring force loading a friction wedge is a function of the spring group travel or vertical motion of the bolster, the spring force is greater when the car is loaded than when the car is empty. Thus, the damping force varies with the car weight. In another arrangement, not shown, instead of the wedge spring acting against the side frame spring seat, it is carried by the bolster, as a consequence of which the damping force is constant regardless of the car weight. The usual form of the friction wedges is illustrated diagrammatically in FIG. 3. The wedge 52 has a column or friction surface 56 which frictionally engages the opposed surface 50 of the side frame column 44. In addition, it has a surface 48 sloping at an angle $\theta$ (in the order of 35 degrees relative to the column surface 56), which surface 48 frictionally engages the opposed sloping surface 54 of a pocket 42 formed in the bolster 40. The pocket 42 accommodates the wedge 52, which is urged upwardly between the side frame column and the bolster by the wedge spring 60, as shown. The primary motion during truck hunting is shown in FIG. 4. The side frames 10 remain parallel with each other while forming the warp angle $\Psi$ with the bolster 14. Now referring particularly to FIGS. 3 and 5, open pockets 42 are formed at each end of the bolster 40 respectively opposite the columns 44 of the associated side frame. The opening into each pocket faces the adjacent side frame column. The pocket is provided with parallel opposed sides 46, and the opposite sides 58 of the wedge 52 are parallel thereto. In the square condition of the assembly the column surfaces of the wedges are in full face engagement with the faces of the side frame columns, and the sloping surfaces respectively of the bolster pockets and the wedges are in full face engagement. When the assembly warps, the bolster assumes a position such as that shown in FIG. 6. This results in a binding between the corners of the wedges 52 and the faces 50 of the side frame columns. The resulting forces $F_c$, spaced at distance g, produce a restoring moment of $gF_c$. This moment increases as the angle $\Psi$ increases, providing the wedges 52 remain secure in the bolster pockets 42. But certain movements of the wedges 52 within the bolster pockets 42 prevent the warp moment $gF_c$ from becoming high enough to preclude truck hunting. These movements may be designated: (1) Horizontal Rotation of the Wedges (FIG. 7); (2) Vertical Rotation of the Wedges (FIG. 8); and (3) Unloading of the Wedges (FIG. 9). In FIG. 16 critical speeds for a 70-ton hopper car are plotted against lateral damping forces for varying values of column restoring moment or warp stiffness. The advantageous effect of high column restoring moment or high warp resistance is apparent. The higher the warp resistance, the higher the critical speed of hunting.

The first undesirable moment is rotation of the wedge 52 in the bolster pocket 42 about a horizontal axis, see FIG. 7. The wedge 52 rotates in the direction shown and slips downwardly slightly in the bolster pocket 42. This permits the corner of the wedge designated "x" to move deeper into the bolster pocket, as a consequence of which the force $F_c$ is reduced, which in turn reduces the warp moment, $gF_c$, and lowers the critical speed of truck hunting. The second undesirable movement is rotation of the wedge 52 in the bolster pocket 42 about a vertical axis, see FIG. 8. The wedge 52 rotates in the direction shown. This motion frees the static friction between the bolster sloping surface 54 and the wedge 52, as a consequence of which the force $F_c$ is reduced, which also reduces the warp moment $gF_c$. Finally, as shown in FIG. 9, under certain conditions the wedge 26 may move downwardly, in the direction of the arrow, in the bolster pocket 38. Due to sloping surface 34 of the wedge 26, the wedge 26 may draw back from the side frame column 22, resulting in a rapid decrease in the force $F_c$, which again reduces the warp moment, $gF_c$.

Figure 10:
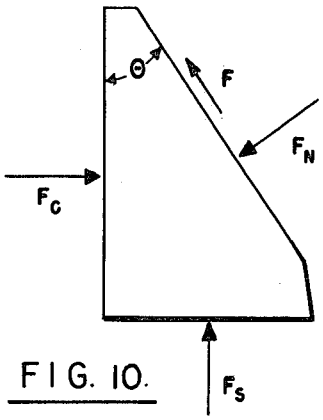
FIG. 10 is a free body diagram of a friction wedge showing the forces acting upon the wedge under static conditions.
Figure 11:
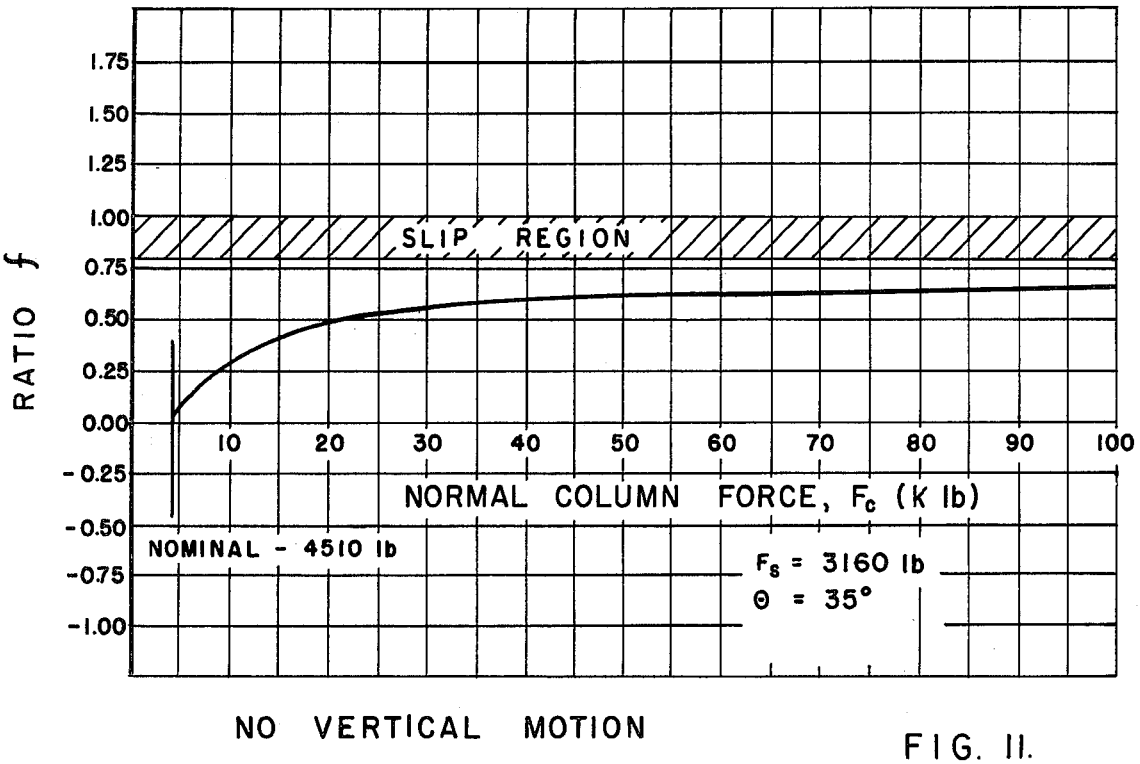
FIG. 11 is a diagram showing the ratio f plotted against the normal column force $F_c$ for the static condition.
Figure 12:
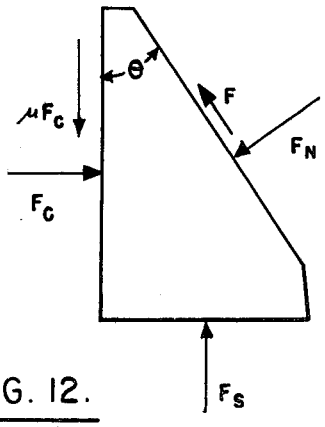
FIG. 12 is a free body diagram of a friction wedge showing the forces acting upon the wedge when the bolster moves upwardly.
Figure 13:
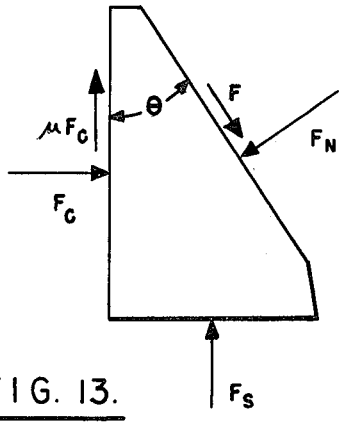
FIG. 13 is a free body diagram of a friction wedge showing the forces acting upon the wedge when the bolster moves downwardly.

The next sequence of figures describes the unloading of the wedges. FIGS. 10, 12 and 13 are diagrams of a wedge showing the forces acting upon the wedge when there is no vertical motion of the bolster and when there is such motion. With regard to the static condition (FIG. 10), it may be shown that $$F_N = F_c \cos\theta + F_s \sin\theta$$

$$F = F_c \sin\theta - F_s \cos\theta$$

where $F_N$ is the force normal to the sloping surface of the wedge, F the corresponding in-plane friction force, $F_c$ the force normal to the column surface of the wedge, and $F_s$ the wedge spring force. In FIG. 11, the ratio $f = {}^F/F_N$, a measure of the static coefficient of friction, is plotted against normal column force $F_c$, and it will be noted that the curve levels off at a value below the static coefficient of friction, which may range between 0.80 and 1.0 for cast steel in static bearing. If the ratio f exceeds the static coefficient of friction, the wedge will slip relative to the bolster pocket and the column force $F_c$ will be reduced considerably.

With regard to upward movement of the bolster (FIG. 12), it may be shown that $$F_N = F_c(\cos\theta - \mu\sin\theta) + F_s \sin\theta \quad \text{(a)}$$

$$F = F_c(\sin\theta + \mu\cos\theta) - F_s \cos\theta, \quad \text{(b)}$$

and with regard to downward movement of the bolster (FIG. 13), it may be shown that $$F_N = F_c(\cos\theta + \mu\sin\theta) + F_s \sin\theta \quad \text{(c)}$$

$$F = F_c(-\sin\theta + \mu\cos\theta) + F_s \cos\theta \quad \text{(d)}$$

Figure 14:
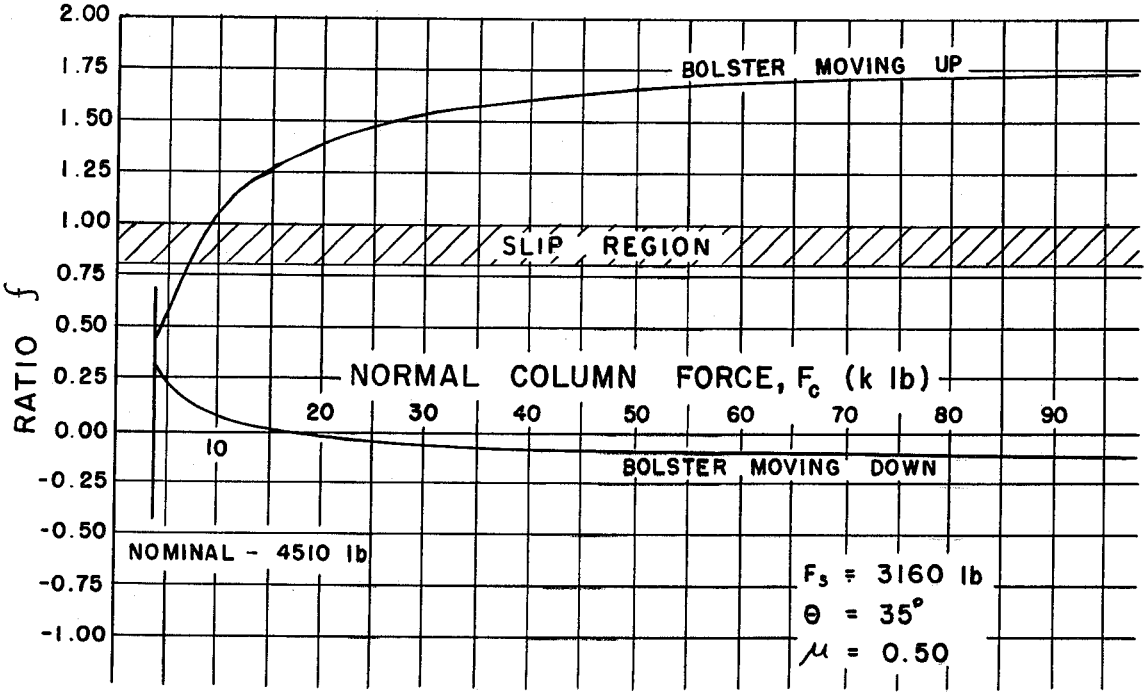
FIG. 14 is a diagram showing the ratio f plotted against normal column force $F_c$ for movement of the bolster upwardly and downwardly.

To find the ratio $f = {}^F/F_N$ the pairs of equations (a) and (b), and (c) and (d) may be used for both upward and downward movement of the bolster, respectively. FIG. 14 shows the ratio f plotted against normal column force $F_c$ for loaded car ($F_s$=3160 lbs.) bolster movement in both directions. The slip region is defined as the region where the static coefficient of friction between the sloping wedge surface and the truck bolster pocket is in the range between 0.80 and 1.0. When the ratio f is equal to or above this range the wedges will slip. If the wedges slip, warp stiffness is reduced substantially because the tight connection between the side frame columns and the bolster is lost. In FIG. 14, the system enters the slip region when $F_c$ approaches 8,000 lbs. for upward motion of the bolster. The ratio f is well behaved for downward motion, ranging between +0.30 and −0.13.

Figure 15:
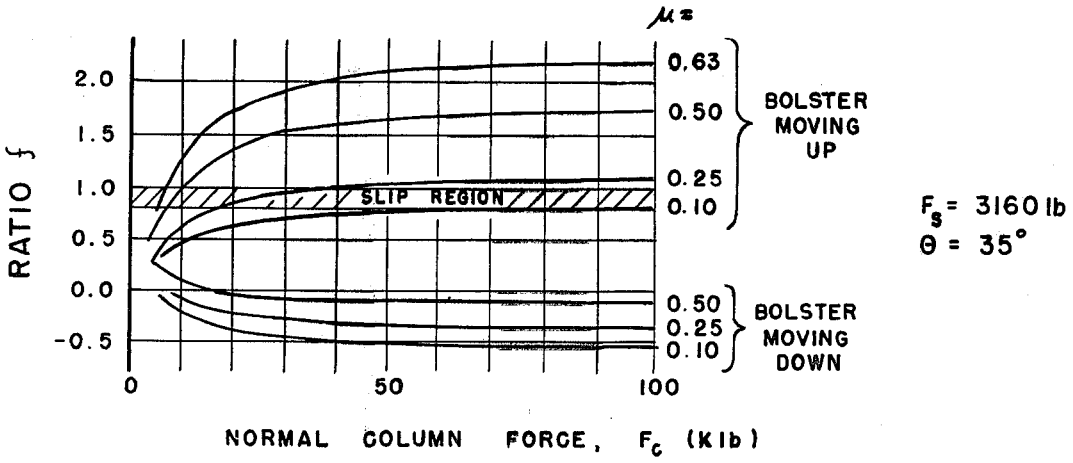
FIG. 15 is a diagram showing the ratio f plotted against normal column force $F_c$ for varying values of the coefficient of friction $\mu$.

A parametric study made to assess the effect of the variables in equations (a), (b), (c) and (d) has led to the following conclusions:

(1) With regard to the coefficient of sliding friction $\mu$: Referring to FIG. 15, although raising the value from 0.50 to 0.63 increases the ratio f for upward motion, the point where the slip region is entered does not change appreciably. By lowering the value to 0.10 the slip region is almost avoided. However, this is a marginal level for practical application, i.e., it does not provide a comfortable margin below the slip region. In the case of downward motion, lowering the value causes higher values of negative ratio f. If these reach the region between −0.8 and −1.0, the wedge may slip downward relative to the bolster.

Figure 17:
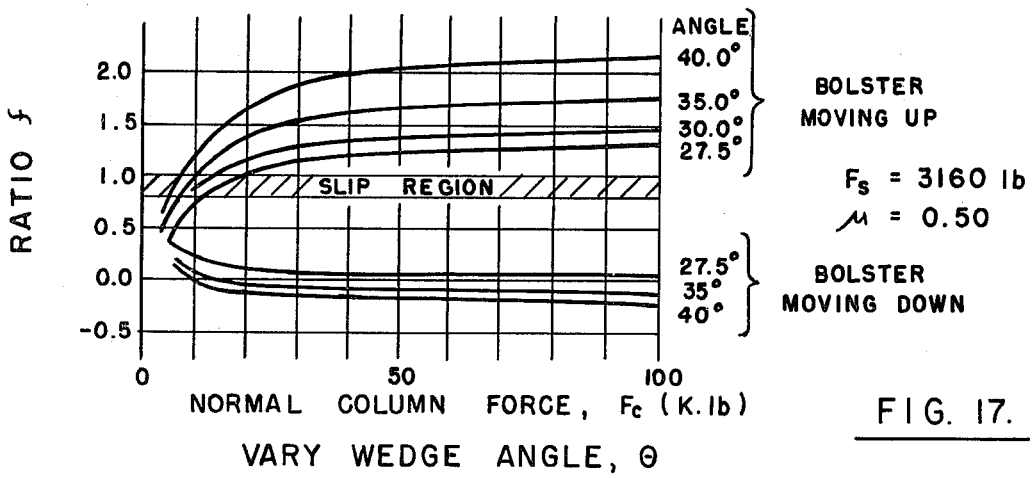
FIG. 17 is a diagram showing the ratio f plotted against normal column force $F_c$ for varying values of wedge angle $\theta$.

(2) With regard to wedge angle $\theta$: Referring to FIG. 17, decreasing the wedge angle lowers the ratio f for upward motion, but it does not have an appreciable effect upon entry into the slip region. The ratio f for downward movement of the bolster is well behaved.

Figure 18:
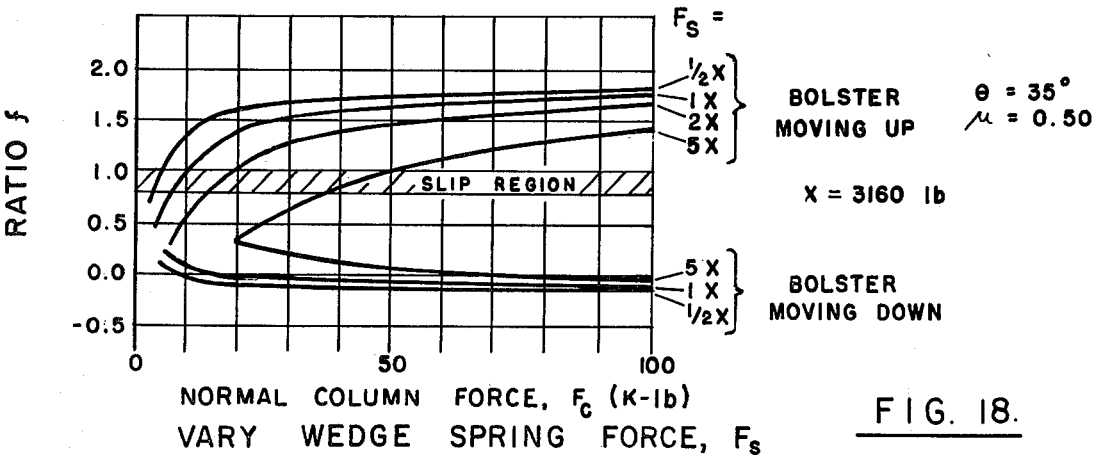
FIG. 18 is a diagram showing the ratio f plotted against normal column force $F_c$ for varying values of wedge spring force $F_s$.

(3) With regard to loaded car wedge spring force $F_s$: Referring to FIG. 18, for upward motion of the bolster increasing the wedge spring force lowers the maximum ratio f and changes entry into the slip region considerably. For downward motion, the system is well behaved.

As a result of the parametric study it was concluded that merely varying a single parameter probably would not result in a practical system to secure the wedges against undesirable unloading during vertical motion, and that to achieve one purpose of this invention it probably would be necessary to vary one or more of the parameters studied. The study suggested reducing the wedge angle $\theta$ from 35 to 30 degrees, reducing the column coefficient of friction from 0.50 to the range of 0.25 to 0.30, and increasing the empty and loaded wedge spring force substantially.

Figure 19:
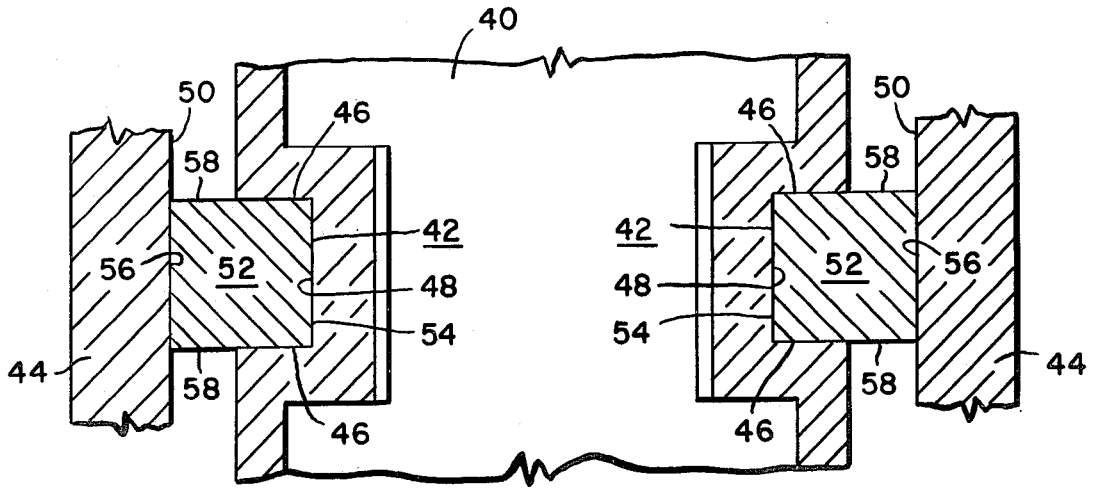
FIG. 19 is similar to FIG. 5, but shows a wedge system embodying the invention.

Horizontal and vertical rotation of the wedge 52 within the pocket 42 of the bolster 40 may be reduced by making tight the fit of the wedge within the boster pocket, as shown in FIG. 19. This increases the warp stiffness significantly. The clearance between the sides 46 of the bolster pocket 42 and the opposed sides 58 of the wedge 52 was reduced to a minimum for a road test. With the wedge thus secured, testing indicated that the on-set of truck hunting was increased significantly.

Figure 3:
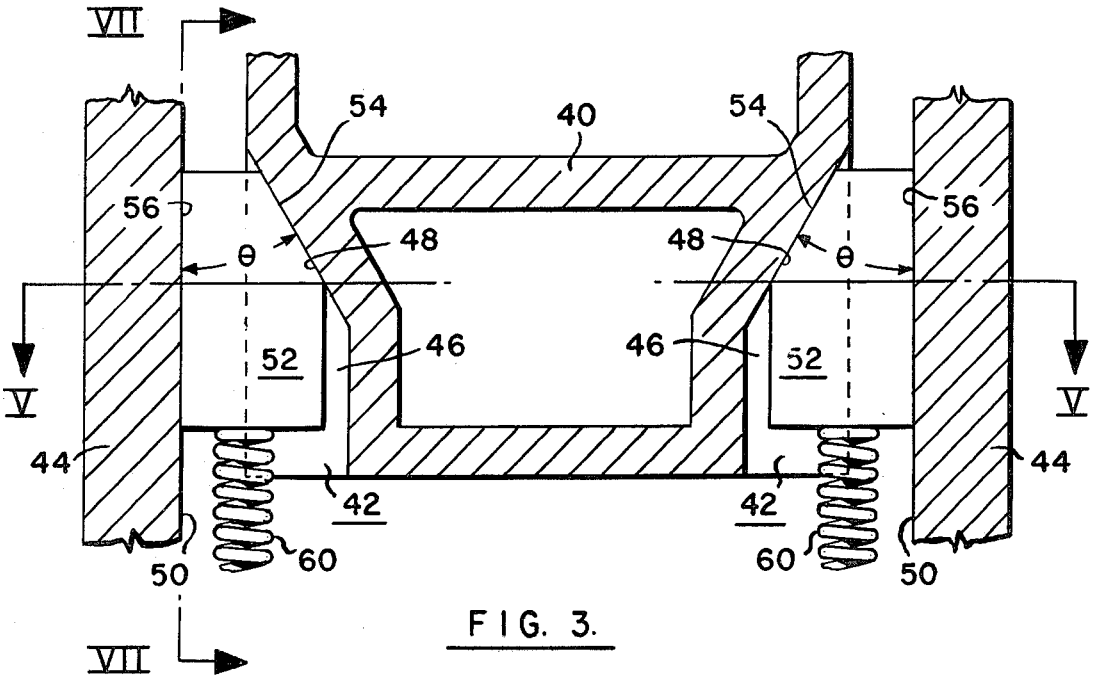
FIG. 3 is a fragmentary vertical section through one end of a bolster showing a conventional wedge system.
Figure 4:
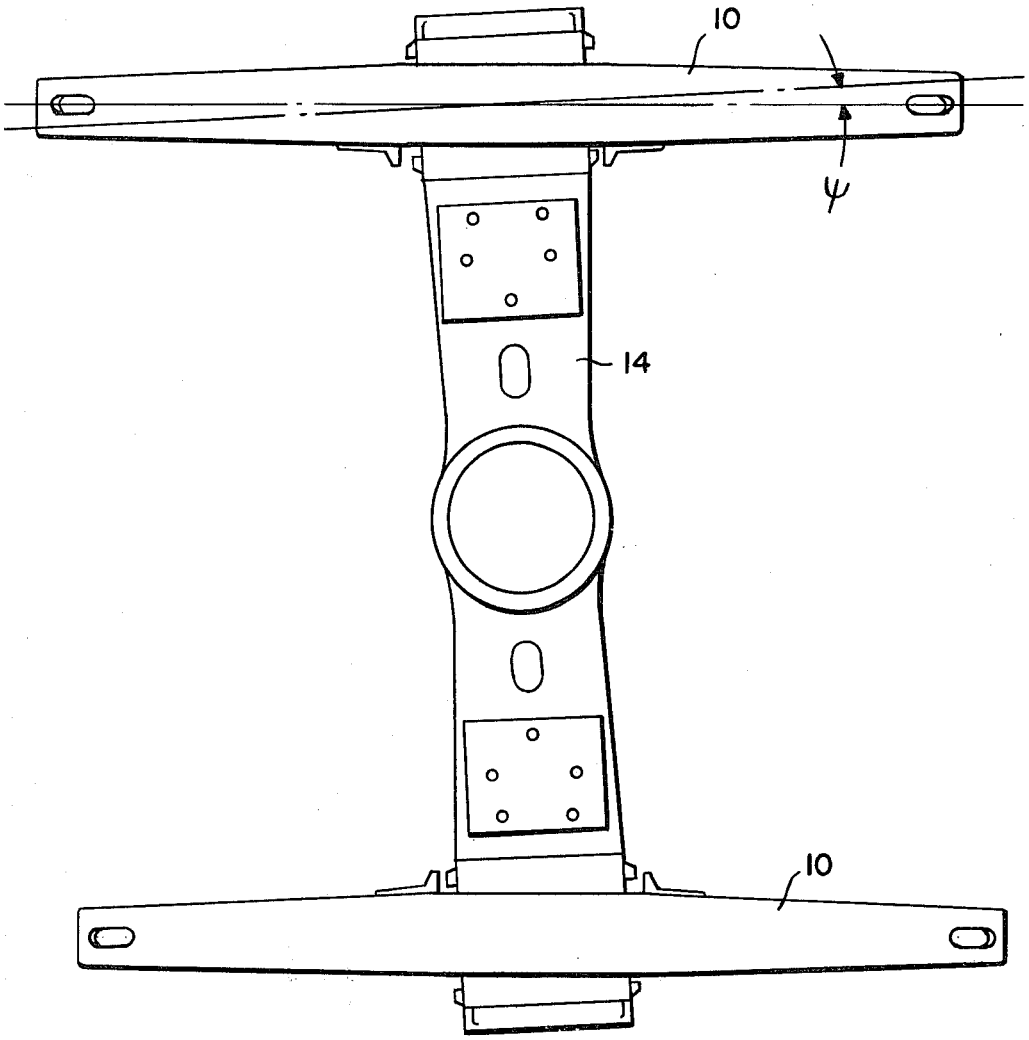
FIG. 4 is similar to FIG. 1, but illustrates orientation of the side frames and bolster during truck hunting.
Figure 20:
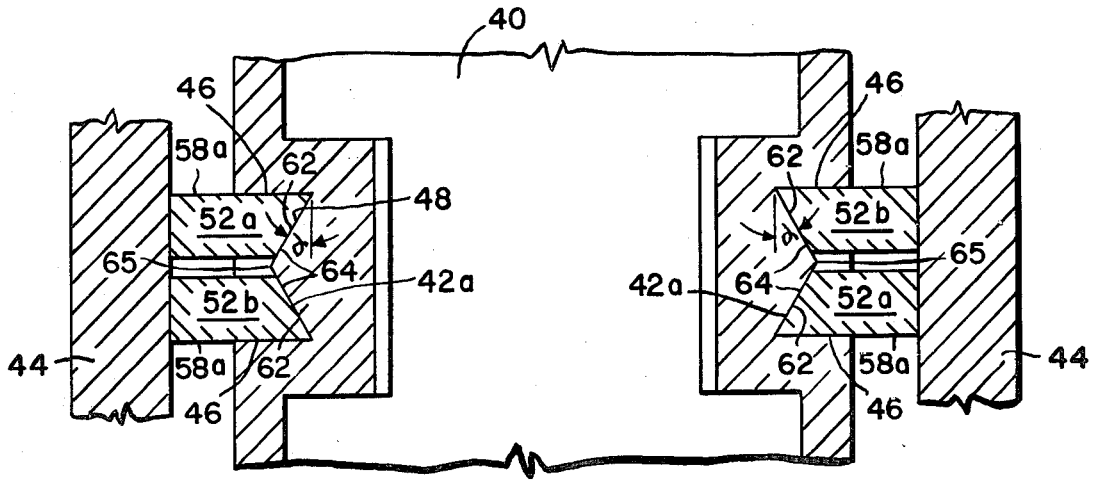
FIG. 20 is similar to FIG. 19, but shows a modified wedge system embodying the invention.

Alternatively, the bottom of the bolster pocket, in addition to sloping as shown in FIG. 3, may be made to slope from each sidewall 46 of the bolster pocket toward the center of the pocket and toward the opening into the pocket, as shown in FIG. 20. The sloping sections 64 of the bolster pocket are flat across the width thereof and merge along the length thereof to form a rectilinear crown 65 disposed midway between the opposed sidewalls of the bolster pocket. The wedge may be in two separate sections 52*a* and 52*b* disposed side-by-side in the pocket 42*a* in slightly spaced relation to one another. The sloping surfaces of the wedge sections are beveled, and the beveled surfaces, designated 62, are disposed in full face engagement with the opposed sloping sections 64 of the pocket, while the remote sides of the wedge sections, designated 58*a*, are in full face engagement respectively with the opposed sides 46 of the pocket. This permits the wedge spring 60 to urge both sections of the wedge against the side frame column 44 by the reaction of angle $\theta$, FIG. 3. Simultaneously, the wedge sections are separately urged respectively against the bolster pocket sidewalls 46 by the angles $\alpha$. Being forced into this position by the combined angles $\alpha$ and the $\theta$ the wedges cannot rotate about either the vertical or horizontal axis.

Figure 21:
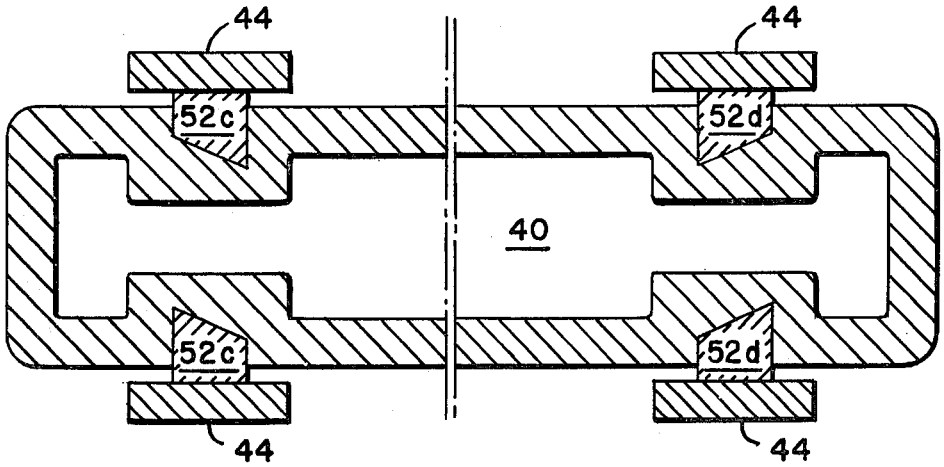
FIG. 21 is a diagrammatic showing of another wedge system embodying the invention.

Another alternative embodiment is indicated diagrammatically in FIG. 21. The construction is similar to that shown in FIG. 19, except that the sloping surfaces of the bolster pocket and the wedge are compound slopes, as indicated in connection with FIG. 20. The wedges at each end of the bolster are fabricated to the same hand, while the wedges on each side of the bolster are fabricated to the right and left hands.

Figure 22:
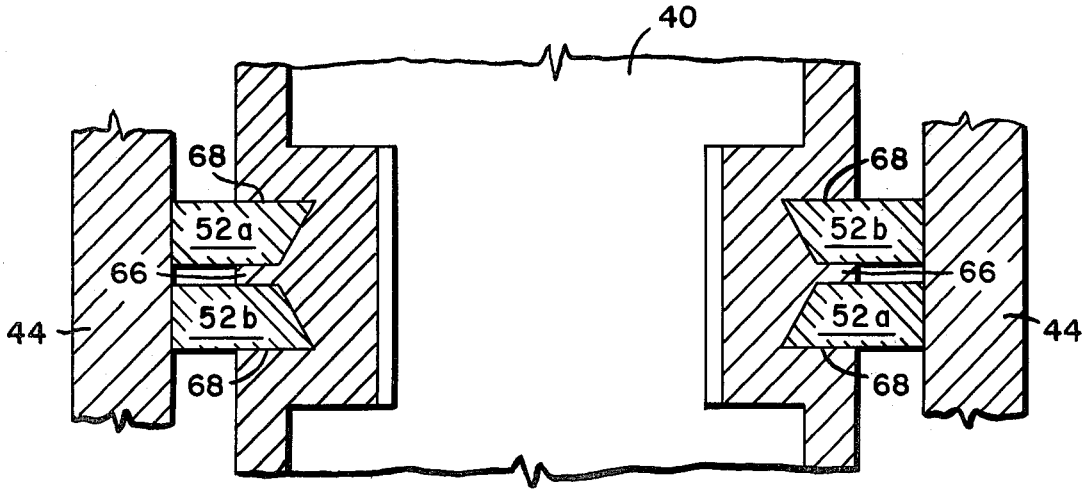
FIG. 22 is similar to FIG. 20, but shows still another modified wedge system embodying the invention.

Still another alternative embodiment is indicated in FIG. 22. The construction is similar to that shown in FIG. 20, except that the pocket 42*a* shown in FIG. 20 is partitioned by a vertically extending wall 66 into two separate sections 68 for respectively accommodating the sections of the wedges 52*a* and 52*b*.

Figure 23:
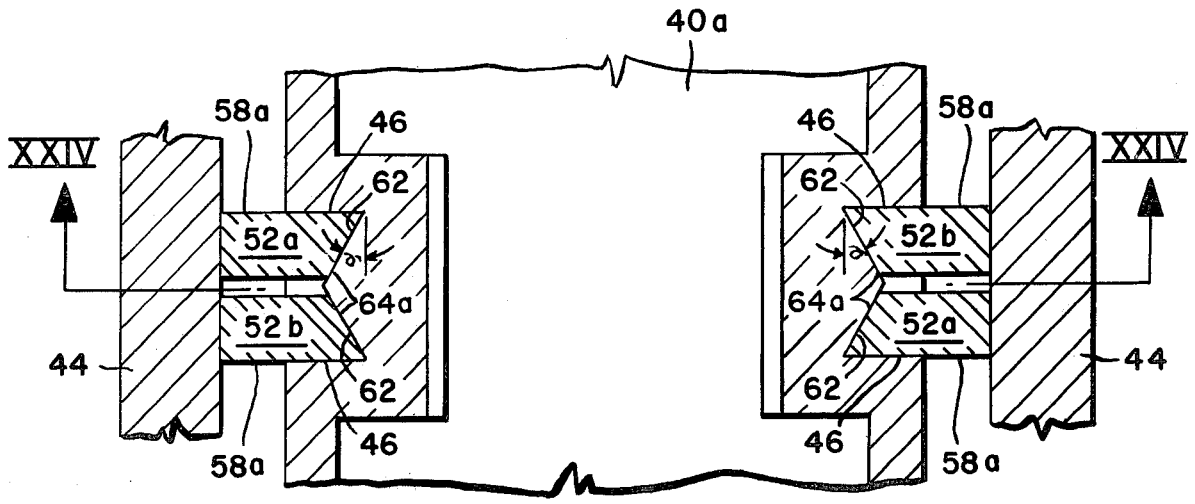
FIG. 23 is similar to FIG. 20, but shows the preferred embodiment of the invention.
Figure 24:
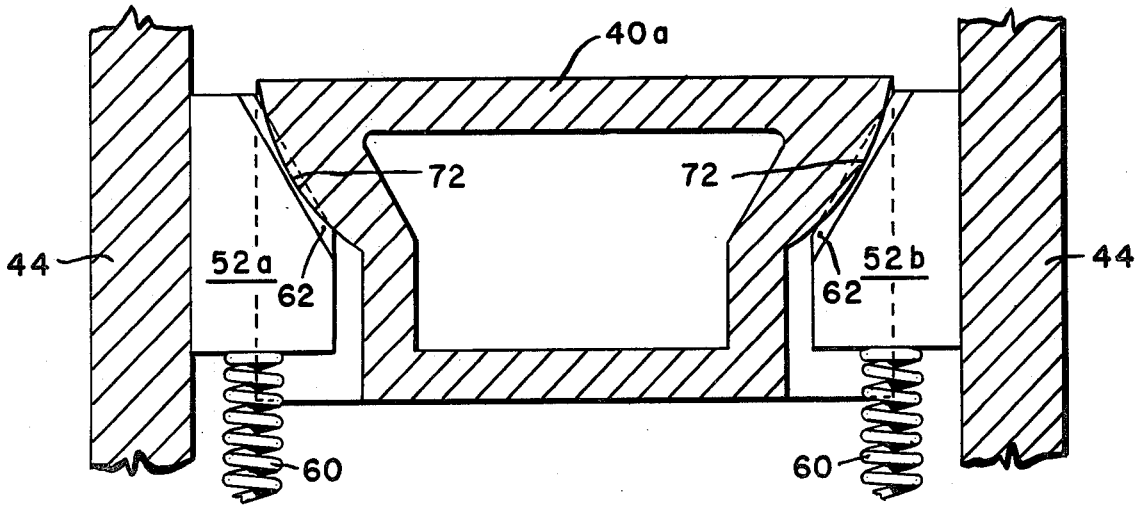
FIG. 24 is a fragmentary vertical section on lines XXIV—XXIV in FIG. 23.

The preferred embodiment, diagrammatically indicated in FIGS. 23 and 24, is very similar to that shown in FIG. 20. The sloping sections 64*a* of the bolster pocket are flat across the width thereof. However, they merge along the length thereof to form a curvilinear crown 72 disposed midway between the opposed sidewalls of the bolster pocket. As a consequence, the sloping sections 64*a* present a convex surface, as viewed looking into the pocket, and the beveled surfaces 62 of the wedges 52*a* and 52*b* are disposed in line contact therewith. Thus, when the bolster tilts to one side, the wedge members rock over the convex surfaces to maintain full face contact between the wedge members and the columns of the side frame members.

Figure 25:
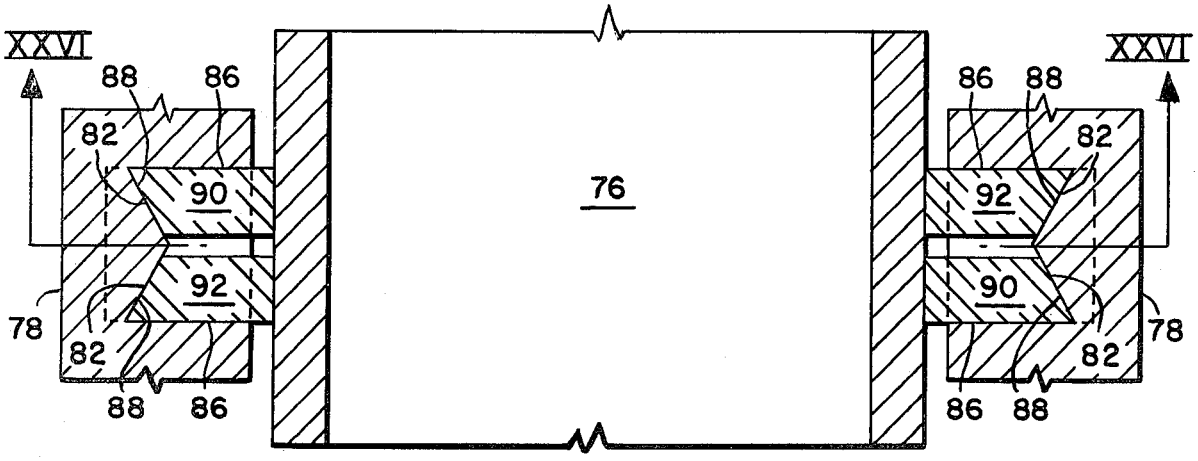
FIG. 25 shows an alternative arrangement of the embodiment of the invention shown in FIG. 23.
Figure 26:
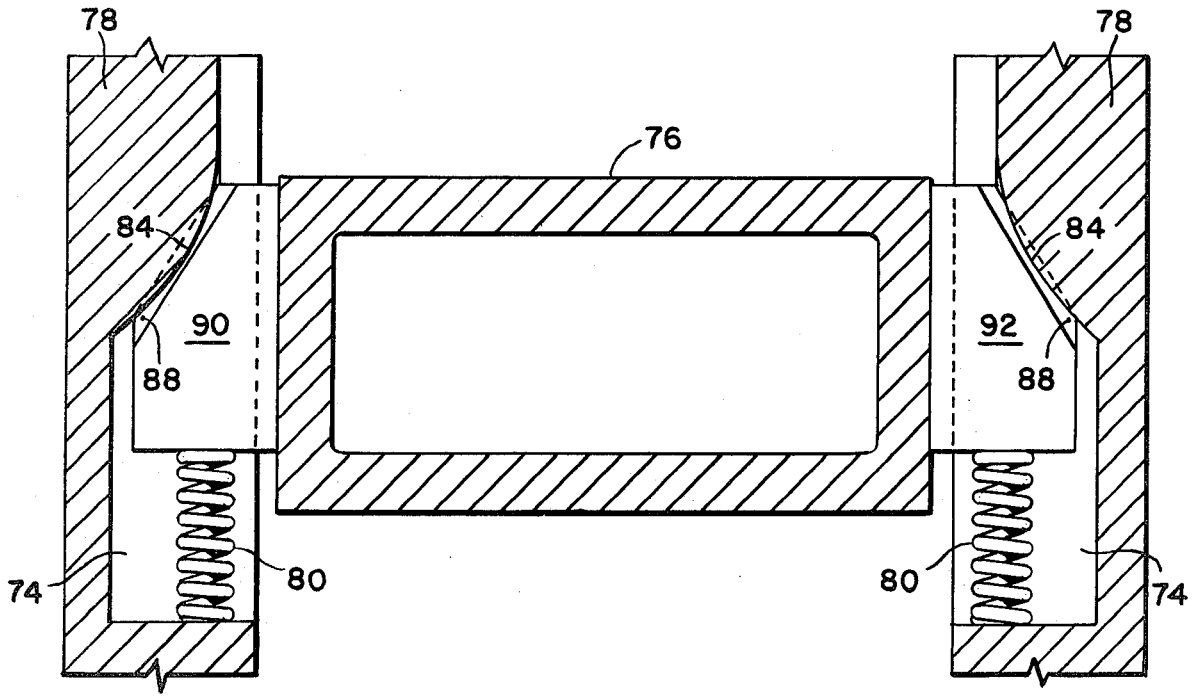
FIG. 26 is a fragmentary vertical section on lines XXVI—XXVI in FIG. 25.

The embodiment of the invention diagrammatically shown in FIGS. 25 and 26 is basically similar to that shown in FIGS. 23 and 24. However, the wedge accommodating pockets 74 are not formed in the bolster 76. Instead, they are formed in the columns 78 of the side frame members. In addition, the wedge springs 80 are housed in the pockets 74. The sloping sections 82 of the pocket 74 are flat across the width thereof and merge along the length thereof to form the curvilinear crown 84 disposed midway between the opposed sidewalls 86 of the pocket 74. As a consequence, the sloping sections 82 present a convex surface, as viewed looking into the pocket, and the beveled surfaces 88 of the wedges 90 and 92 are disposed in line contact therewith. Thus, when the bolster 76 tilts to one side, the wedge members 90 and 92 rock over the convex surfaces as required to maintain full face contact between the wedge members and the sides of the bolster.

An embodiment of the invention entails one or more of the following:

(1) Reduced wedge angle $\theta$.
(2) Reduced coefficient of friction $\mu$.
(3) Increased snubber spring force $F_s$.
(4) Wedge and bolster pocket arranged to preclude horizontal and vertical wedge rotation.

While in accordance with the provisions of the patent statutes, we have illustrated the best form of the embodiment of our invention now known to us, it will be apparent to those skilled in the art that changes may be made in the form of the wedge system described without departing from the spirit and scope of the invention as set forth in the appended claims.

What is claimed is:

1. In a freight car truck assembly,

A. a pair of laterally spaced wheeled side frame members each having a bolster opening defined by means including a pair of laterally spaced column members with opposed friction surfaces defining the width of said opening, B. a bolster member spanning said side frame members and having opposite end portions respectively projecting into said bolster openings, the opposite side surface areas of each bolster end portion respectively opposed to said friction surfaces being disposed respectively in close spaced relation thereto, C. means mounting said bolster member upon said side frame members comprising 1. means interposed between said bolster and said frame members and operative for yieldably supporting said bolster member on said side frame members, 2. a system of wedge members interposed between said bolster and column members, each of said wedges being disposed in a pocket formed in one of said bolster and column members with oppositely facing sides thereof respectively in close, sliding engagement with opposed sides of the pocket, and 3. yieldable means urging each of said wedge members into an effective working position wherein the sloping and friction surfaces of the wedge member are in sliding engagement respectively with the sloping surface of the pocket formed in one of said bolster and column members and with the other of said members.

2. In the freight car truck assembly according to claim 1, wherein the wedge accommodating pockets are formed in the bolster member, and the wedge members are secured respectively in said pockets for turning movement with said bolster member, without lost motion, when the bolster member turns relative to the side frame members under the influence of a warp inducing effort applied to said assembly.

3. In the freight car truck assembly according to claim 2, wherein the wedge members are secured in said pockets against turning therein about a vertical axis and about a selected horizontal axis each normal to said bolster member.

4. In the freight car truck assembly according to claim 3, wherein each wedge is a one-piece member, and the interface between opposed sloping surfaces respectively of the wedge member and bolster pocket is flat across the full width of said wedge member and bolster pocket.

5. In the freight car truck assembly according to claim 4, wherein the sloping surface of the bolster pocket extends deeper into said pocket on one side thereof than on the other thereby to form a groove V-shaped in transverse section, one side of said groove being a side of said pocket and the other being the sloping surface of said pocket, and the wedge member is provided with a sloping surface beveled for slidably fitting into said groove.

6. In the freight car truck assembly according to claim 5, wherein the beveled surfaces of the wedge members at each end of the bolster member slope in the same direction, and the beveled surfaces of the wedge members on a first side of the bolster member diverge toward the other side, while the beveled surfaces of the wedge members on said other side converge toward said first side.

7. In the freight car truck assembly according to claim 3, wherein the sloping surface of the bolster pocket is deeper at the opposed sidewalls of the pocket than at the center thereof whereby the sections of said surface respectively adjacent said opposed sidewalls have a compound slope, said sections of the sloping surface of the bolster pocket merge along the length of said sloping surface of the bolster pocket and thereby form a rectilinear crown, and each wedge comprises a pair of sections disposed in side-by-side relation in the associated bolster pocket, the sloping surface of each wedge section being in full face engagement with the opposed surface of the bolster pocket having a compound slope.

8. In the freight car truck assembly according to claim 7, wherein the sloping surface of the bolster pocket is convex when viewed looking into the pocket, the rectilinear crown extending along the length of said sloping surface of the bolster pocket is disposed centrally between the opposed sidewalls of said pocket, and the sections of the sloping surface of the bolster pocket respectively on opposite sides of said crown are each flat across the width thereof.

9. In the freight car truck assembly according to claim 3, wherein the sloping surface of the bolster pocket is deeper at the opposed sidewalls of the pocket than at the center thereof whereby the sections of said surface respectively adjacent said opposed sidewalls have a compound slope, said sections of the sloping surface of the bolster pocket merge along the length of said sloping surface of the bolster pocket and thereby form a crown, the sections of said sloping surface of the bolster pocket respectively on opposite sides of said crown are each flat across the width thereof, each wedge comprises a pair of sections disposed in side-by-side spaced relation in the associated bolster pocket, and one of said crown and the sloping surfaces of said wedge sections is curvilinear to provide for rocking of side wedge sections upon said sloping surface of the bolster pocket when said bolster member tilts to one side.

10. In the freight car truck assembly according to claim 3, wherein the sloping surface of the bolster pocket is deeper at the opposed sidewalls of the pocket than at the center thereof whereby the sections of said surface respectively adjacent said opposed sidewalls have a compound slope, said sections of the sloping surface of the bolster pocket merge along the length of said sloping surface of the bolster pocket and thereby form a curvilinear crown, and each wedge comprises a pair of sections disposed in side-by-side spaced relation in the associated bolster pocket, the sloping surface of each wedge section being in line contact with the associated section of the sloping surface of the bolster pocket.

11. In the freight car truck assembly according to claim 10, wherein the sloping surface of the bolster pocket is convex when viewed looking into the pocket, the curvilinear crown extending along the length of said sloping surface of the bolster pocket is disposed centrally between the opposed sidewalls of said pocket, and the sections of said sloping surface of the bolster pocket respectively on opposite sides of said crown are each flat across the width thereof.

12. In the freight car truck assembly according to claim 3, wherein the sloping surface of the bolster pocket is deeper at the opposed sidewalls of the pocket than at the center thereof whereby the sections of said surface respectively adjacent said opposed sidewalls have a compound slope, said sections of the sloping surface of the bolster pocket merge along the length of said sloping surface of the bolster pocket and thereby form a crown, the sections of said sloping surface of the bolster pocket respectively on opposite sides of said crown are each flat across the width thereof, each wedge comprises a pair of sections disposed in side-by-side spaced relation in the associated bolster pocket, and said wedge sections are urged into effective working position simultaneously by coil spring means seated upon one of said bolster and side frame members.

13. In the freight car truck assembly according to claim 3, wherein the wedge angle is substantially less than 35 degrees.

14. In the freight car truck assembly according to claim 3, wherein the wedge angle is approximately 30 degrees.

15. In the freight car truck assembly according to claim 1, wherein the wedge accommodating pockets are formed in the columns of the side frame members, and the wedge members are secured respectively in said pockets against turning therein about a vertical axis and a selected horizontal axis.

16. In the freight car truck assembly according to claim 15, wherein the sloping surface of the wedge accommodating pocket is deeper at the opposed sidewalls of the pocket than at the center thereof whereby the sections of said surface respectively adjacent said opposed sidewalls have a compound slope, said sections of the sloping surface of the pocket merge along the length of said sloping surface of the pocket and thereby form a crown, the sections of said sloping surface of the pocket respectively on opposite sides of said crown are each flat across the width thereof, each wedge comprises a pair of sections disposed in side-by-side relation in the associated pocket, and one of said crown and the sloping surfaces of said wedge sections is curvilinear to provide for rocking of said wedge sections upon said sloping surface of the pocket when said bolster member tilts to one side.

17. In the freight car truck assembly according to claim 15, wherein the sloping surface of the wedge accommodating pocket is deeper at the opposed sidewalls of the pocket than at the center thereof whereby the sections of said surface respectively adjacent said opposed sidewalls have a compound slope, said sections of the pocket merge along the length of said sloping surface of the pocket and thereby form a curvilinear crown, and each wedge comprises a pair of sections disposed in side-by-side spaced relation in the associated pocket, the sloping surface of each wedge section being in line contact with the associated section of the sloping surface of the pocket.

18. In the freight car truck assembly according to claim 17, wherein the sloping surface of the wedge accommodating pocket is convex when viewed looking into the pocket, the curvilinear crown extending along the length of said sloping surface of the pocket is disposed centrally between the opposed sidewalls of said pocket, and the sections of said sloping surface of the pocket respectively on opposite sides of said crown are each flat across the width thereof.

19. In the freight car truck assembly according to claim 15, wherein the sloping surface of the wedge accommodating pocket is deeper at the opposed sidewalls of the pocket than at the center thereof whereby the sections of said surface respectively adjacent said opposed sidewalls have a compound slope, said sections of the sloping surface of the pocket merge along the length of said sloping surface of the pocket and thereby form a crown, the sections of said sloping surface of the pocket respectively on opposite sides of said crown are each flat across the width thereof, each wedge comprises a pair of sections disposed in side-by-side spaced relation in the associated pocket, said wedge sections are urged into effective working position simultaneously by coil spring means housed in said pocket and seated upon the bottom thereof.

20. In a freight car truck assembly,

A. a pair of laterally spaced wheeled side frame members each provided with a bolster opening defined by means including a tension member, a compression member and a pair of laterally spaced column members with opposed vertically extending friction surfaces defining the width of said opening, B. a bolster member spanning said side frame members and having opposite end portions respectively projecting into said bolster openings, the opposite side surface areas of each bolster end portion respectively opposed to said friction surfaces being disposed respectively in close spaced relation thereto, said bolster being free, within limits, for turning in said openings relative to said side frame members under the influence of a warp-inducing effort applied to said assembly, and being provided with open pockets respectively opposite said friction surfaces, each of said pockets having a sloping surface deeper at the opposed sidewalls of the pocket than at the center thereof whereby the sections of said surface respectively adjacent said opposed sidewalls having a compound slope, and said sections of the sloping surface of the bolster pocket merge centrally along the length of the sloping surface of the bolster pocket and thereby form a curvilinear crown, C. a spring group interposed between each of said tension members and the associated end portion of said bolster member and operative to yieldably support said bolster member, and D. a wedge system at each of said side frame columns including 1. a wedge member slidably fitting into each bolster pocket and comprising a pair of sections disposed in side-by-side spaced relation, the sloping surface of each wedge section being in line contact with the associated section of the sloping surface of the bolster pocket, and
2. spring means reacting against the side frame and urging the sections of the wedge member into effective working position between the bolster and side frame members, the wedge members being thereby secured respectively in said pockets for turning movement with said bolster member, without lost motion, when the bolster member turns relative to said side frame members under the influence of a warp inducing effort applied to said assembly.

21. In a freight car truck assembly,

A. a pair of laterally spaced wheeled side frame members each provided with an opening therein defined by means including a tension member, a compression member and a pair of laterally spaced column members, the opposed faces respectively of said column members being provided with opposed open pockets each having a sloping surface deep at the opposed sideswalls of the pocket than at the center thereof whereby the sections of said surface respectively adjacent said sidewalls have a compound slope, and said sections of the sloping surface of the pocket merge centrally along the length of the sloping surface of the pocket and thereby form a curvilinear crown, B. a bolster member spanning said side frame members and disposed normal thereto with opposite end portions thereof projecting respectively into said openings, the opposite side surface areas of each bolster end portion respectively opposed to said column members being disposed respectively in close spaced relation thereto, said bolster member being free, within limits, for turning within said openings relative to said frame members under the influence of a warp-inducing effort applied to said assembly, C. a spring group interposed between each of said tension members and the associated end portion of said bolster member and operative to yieldably support said bolster member, and D. a wedge system at each of said side frame columns including 1. a wedge member slidably fitting into each of said pockets and comprising a pair of sections disposed in side-by-side spaced relation, the sloping surface of each wedge section being in line contact with the associated section of the sloping surface of the side frame column pocket, and 2. spring means housed in said side frame member and reacting against said side frame member to urge the sections of the wedge member into effective working position between the side frame and bolster members, the wedge members being thereby secured respectively against turning movement with said bolster member when said bolster turns relative to said side frame members under the influence of a warp-inducing effort applied to said assembly.

* * * * *

UNITED STATES PATENT AND TRADEMARK OFFICE

CERTIFICATE OF CORRECTION

PATENT NO. : 4,244,298

DATED : January 13, 1981

INVENTOR(S) : V. Terrey Hawthorne, Stuart A. Schwam

It is certified that error appears in the above—identified patent and that said Letters Patent is hereby corrected as shown below:

Column 2, line 44, change "4" to --14--.

Column 6, line 61, change "said" second occurrence, to --side--.

Column 8, line 18, change "side" to --said--.

Column 10, line 48, change "deep" to --deeper--.

Signed and Sealed this

*Twelfth* Day of *October 1982*

[SEAL]

*Attest:*

GERALD J. MOSSINGHOFF

*Attesting Officer*

*Commissioner of Patents and Trademarks*